US010667594B2

(12) United States Patent
Aso

(10) Patent No.: US 10,667,594 B2
(45) Date of Patent: Jun. 2, 2020

(54) WIPER FOR COSMETIC CONTAINER

(71) Applicant: SINWA CORPORATION, Kanagawa (JP)

(72) Inventor: Hironori Aso, Kanagawa (JP)

(73) Assignee: SINWA CORPORATION, Kanagawa (JP)

( * ) Notice: Subject to any disclaimer, the term of this patent is extended or adjusted under 35 U.S.C. 154(b) by 115 days.

(21) Appl. No.: 16/074,020

(22) PCT Filed: Feb. 4, 2016

(86) PCT No.: PCT/JP2016/053338

§ 371 (c)(1),
(2) Date: Jul. 30, 2018

(87) PCT Pub. No.: WO2017/134791

PCT Pub. Date: Aug. 10, 2017

(65) Prior Publication Data

US 2018/0325239 A1 Nov. 15, 2018

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)

(58) Field of Classification Search
CPC .... A45D 34/00; A45D 34/042; A45D 34/043; A45D 34/045; A45D 34/046;
(Continued)

(56) References Cited

U.S. PATENT DOCUMENTS 5,190,389 A * 3/1993 Vasas ..... A45D 34/046 401/122
8,142,093 B2 * 3/2012 Vanoncini ..... A45D 40/267 401/121

(Continued)

FOREIGN PATENT DOCUMENTS

DE 2737667 A1 2/1979
JP 11244043 A 9/1999

(Continued)

OTHER PUBLICATIONS

International Search Report issued in the corresponding Application No. PCT/JP2016/053338 dated Apr. 19, 2016.

*Primary Examiner* — David J Walczak
(74) *Attorney, Agent, or Firm* — Roberts Calderon Safran & Cole P.C.

(57) ABSTRACT

Provided is a wiper for a cosmetic container, capable of obtaining sufficient strength even when a force in a rotating direction is applied. A wiper for a cosmetic container includes a cylindrical first member to be fixed to an inner circumference of an opening of a cosmetic container, and a cylindrical second member that is double-molded on a lower end portion of the first member, wherein joining portions of the first member and the second member respectively include horizontal surfaces, on the horizontal surface of either one of the first member and the second member, projection portions projecting from the horizontal surface are formed discretely in the circumferential direction, and on the horizontal surface of the other member, recess portions in which the projection portions are inserted are formed.

8 Claims, 7 Drawing Sheets

(58) Field of Classification Search
CPC .. A45D 34/047; A45D 40/262; A45D 40/264; A45D 40/265; A45D 40/267; A45D 40/268
See application file for complete search history.

(56) References Cited

U.S. PATENT DOCUMENTS

| | | | | |
|---|---|---|---|---|
| 8,721,210 | B2 * | 5/2014 | Wilczynski ..... | A45D 40/267 401/122 |
| 10,517,372 | B2 * | 12/2019 | Tarling ..... | A45D 34/046 |
| 2007/0127974 | A1 | 6/2007 | Chang et al. | |
| 2011/0222954 | A1 | 9/2011 | Salciarini et al. | |

FOREIGN PATENT DOCUMENTS

| | | | |
|---|---|---|---|
| JP | 2003319823 | A | 11/2003 |
| JP | 2004194773 | A | 7/2004 |
| JP | 2008531196 | A | 8/2008 |
| JP | 2014014620 | A | 1/2014 |
| WO | 2006013408 | A1 | 2/2006 |

* cited by examiner

WIPER FOR COSMETIC CONTAINER

CROSS-REFERENCE TO RELATED APPLICATIONS

The present application is a U.S. National Phase of PCT/JP2016/053338 filed on Feb. 4, 2016. The disclosure of the PCT Application is hereby incorporated by reference into the present Application.

TECHNICAL FIELD

The present invention relates to a wiper to be fitted to an inner circumference of an opening of a cosmetic container that contains a cosmetic liquid such as a mascara, an eyeliner, and a lip gloss, etc.

BACKGROUND ART

To an inner circumference of an opening of a cosmetic container of a cosmetic applicator, a wiper is fitted to scrape-off excessive cosmetic liquid attached to an application portion when the application portion is pulled out from the cosmetic container. An upper end side of the wiper preferably has appropriate rigidity so as to prevent the wiper from coming out from the container when the application portion is pulled out, and a lower end side of the wiper preferably has sufficient flexibility so as to scrape-off only excessive cosmetic on the application portion. Therefore, there is a wiper whose lower end side is formed from a material with rigidity lower than that of a wiper upper end side by double molding (Patent Literatures 1 and 2).

CITATION LIST

Patent Literature

Patent Literature 1: International Publication WO 2006/013408

Patent Literature 2: U.S. Pat. No. 8,721,210

SUMMARY OF THE INVENTION

Technical Problem

However, in each of the wipers described in Patent Literatures listed above, a member of the wiper upper end side and a member of the wiper lower end side are joined by forming, in the entire circumferential region a wall-shaped edge portion formed by decreasing a thickness of a joining portion of one of the members toward a free end and a wall-shaped groove portion formed on a joining portion of the other member to have a shape corresponding to the edge portion. Therefore, there is a problem in which, although the strength of the applicator in its shaft direction is sufficient because the edge portion and the groove portion interfere with each other in the vertical direction, when a force in a rotating direction is applied to the wiper, it is difficult to obtain sufficient strength.

The present invention was made in view of the problem of the conventional techniques, and an object thereof is to provide a wiper for a cosmetic container capable of obtaining sufficient strength even when a force in a rotating direction is applied thereto.

Solution to Problem

In order to solve the above-described problem, a wiper for a cosmetic container according to an aspect of the present invention includes a cylindrical first member to be fixed to an inner circumference of an opening of a cosmetic container, and a cylindrical second member that is double-molded on a lower end portion of the first member, wherein joining portions of the first member and the second member respectively have horizontal surfaces, on the horizontal surface of either one of the first member and the second member, projection portions projecting from the horizontal surface are formed discretely in a circumferential direction, and on the horizontal surface of the other member, recess portions in which the projection portions are inserted are formed.

In the aspect described above, it is also preferable that the second member is formed into a truncated cone shape narrowing from the joining portion toward a free end portion of the second member and includes a stepped portion formed stepwise in one region of a circumferential direction of an outer surface of the second member, and a gate portion is provided on the stepped portion.

In the aspect described above, it is also preferable that the second member includes a swelling portion formed by swelling an inner surface of the region in which the stepped portion is formed.

In the aspect described above, it is also preferable that the number of steps in the stepped portion is two.

In the aspect described above, it is also preferable that the gate portion is provided on a vertical portion between a first step and a second step of the stepped portion.

Advantageous Effects of the Invention

According to the present invention, a wiper for a cosmetic container capable of obtaining sufficient strength even when a force in a rotating direction is applied thereto is obtained.

DESCRIPTION OF EMBODIMENTS

A preferred embodiment of the present invention is described with reference to the drawings. The up-down direction and the vertical direction in this description are the arrow U-D direction in FIG. 1. The horizontal direction is the arrow L-R direction in FIG. 1.

Figure 1:
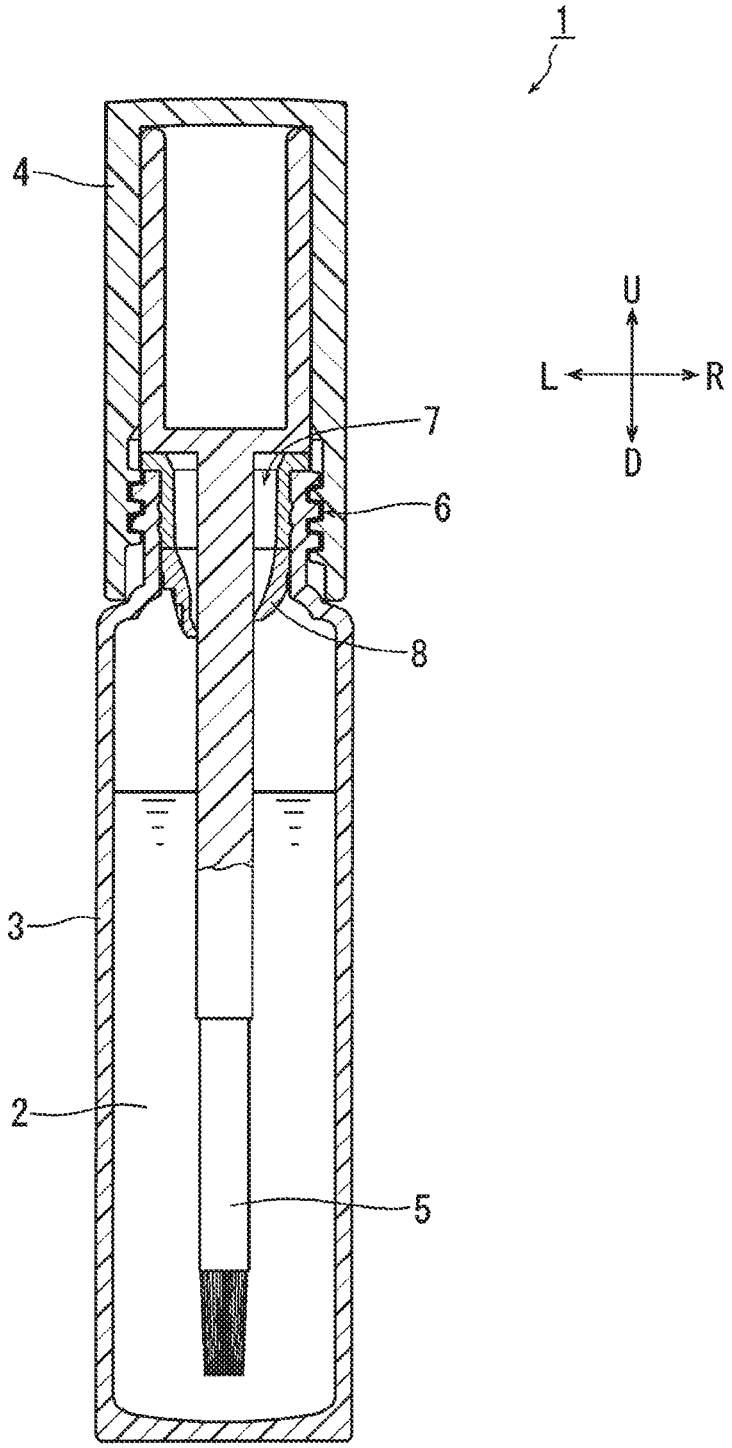
FIG. 1 is a longitudinal sectional view of a cosmetic applicator according to an embodiment.

FIG. 1 is a longitudinal sectional view of a cosmetic container according to an embodiment. The reference sign 1 denotes a cosmetic applicator, and the cosmetic applicator 1 includes a cosmetic container 3 that contains a cosmetic liquid 2, a cap 4 that can be fitted to the cosmetic container 3, and an application portion 5 formed integrally with the cap 4. The cosmetic container 3 is a bottomed cylinder, has a diameter reduced on an upper end side, and has an opening 7 at an upper end of the reduced-diameter portion 6. To an inner circumference of the opening 7, a wiper 8 is press-fitted and fixed.

Figure 2:
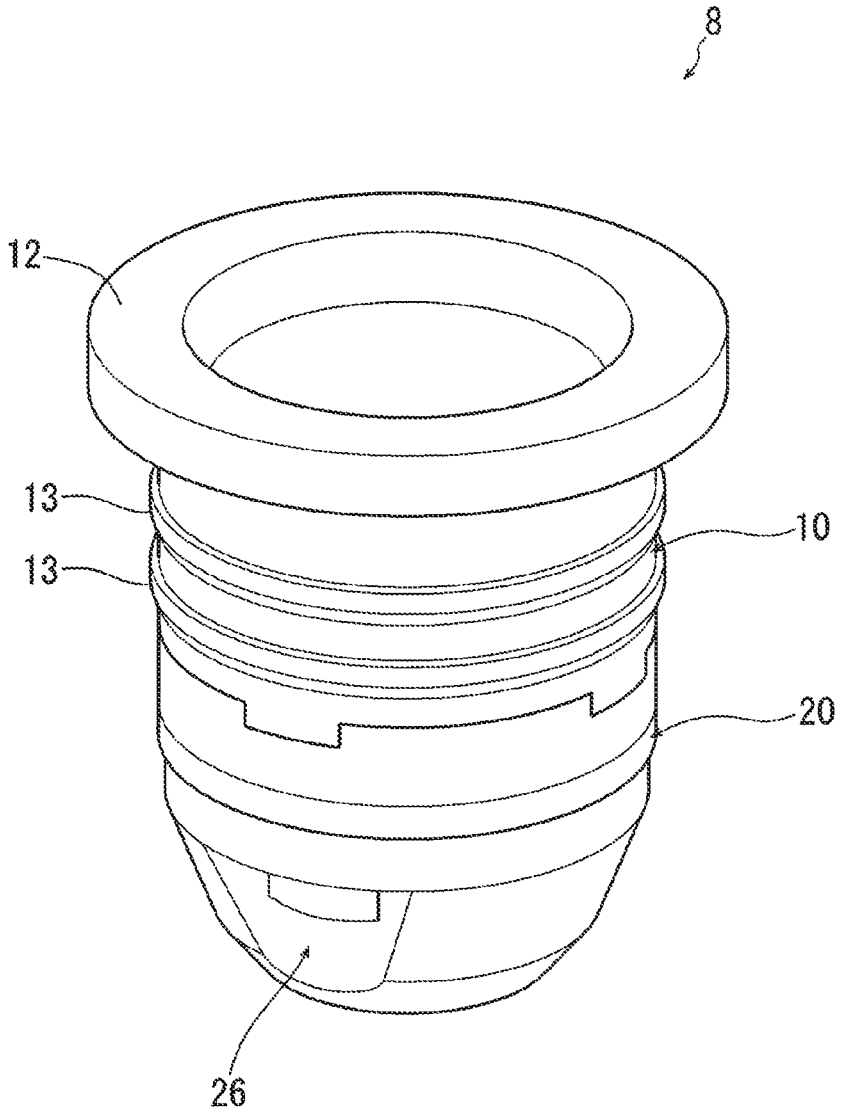
FIG. 2 is a perspective view showing a wiper in FIG. 1.
Figure 3:
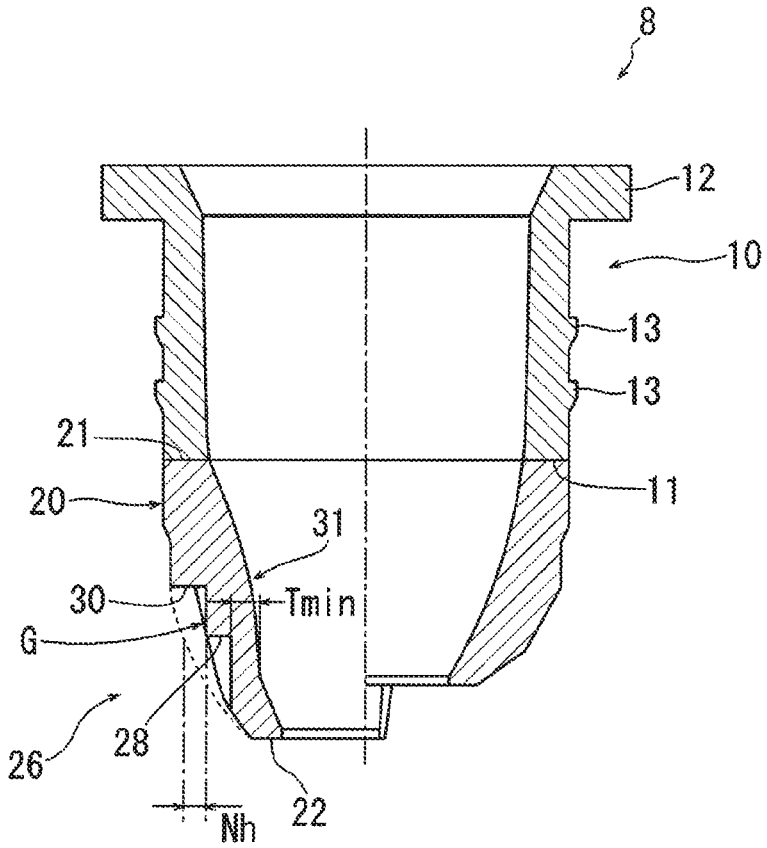
FIG. 3 is a longitudinal sectional view showing the wiper in FIG. 1.
Figure 4:
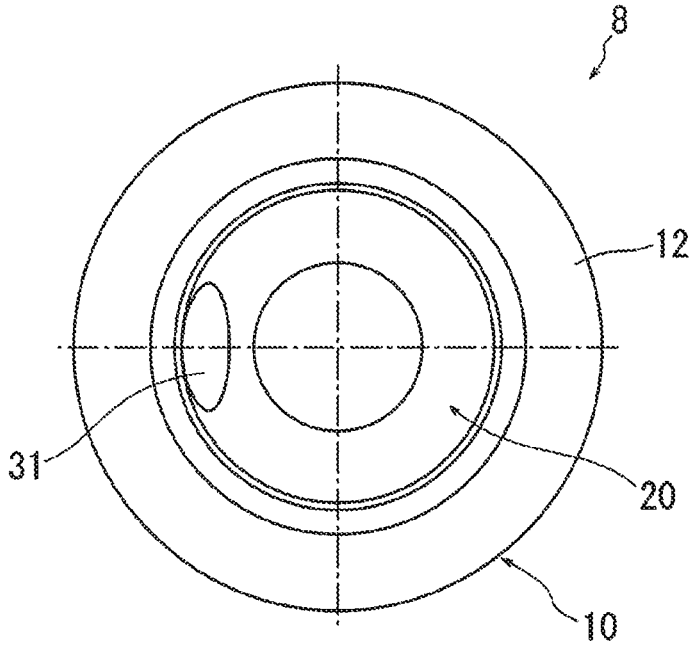
FIG. 4 is a plan view of FIG. 3.
Figure 5:
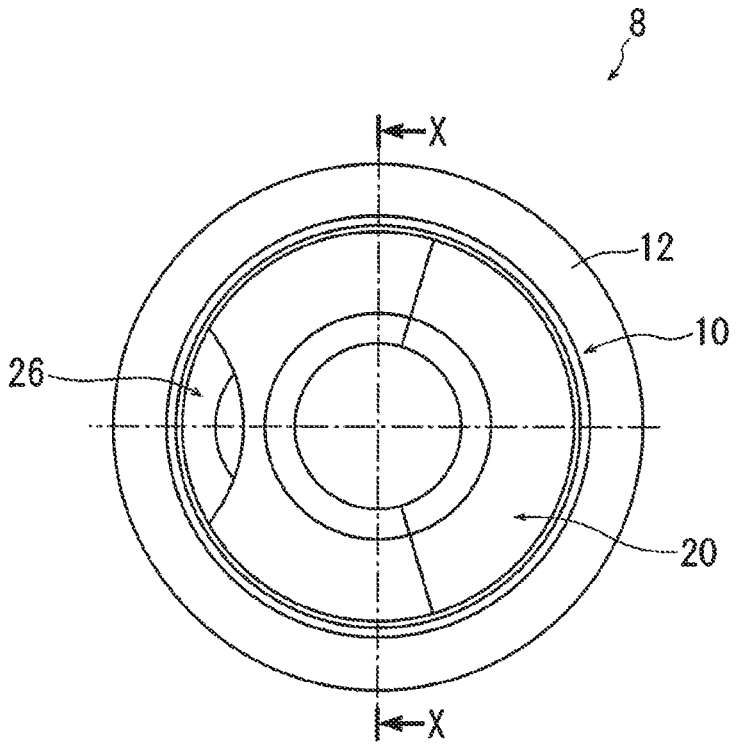
FIG. 5 is a bottom view of FIG. 3.
Figure 8:
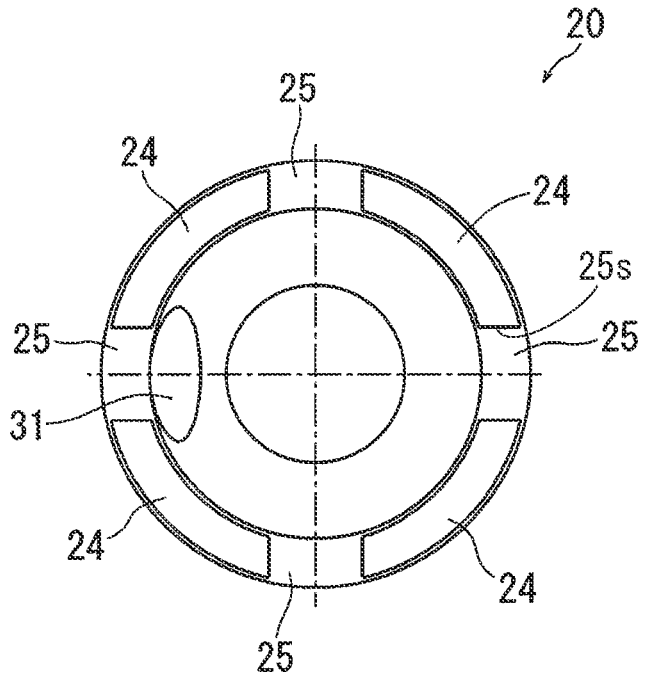
FIG. 8 is a longitudinal sectional view of a second member.
Figure 9:
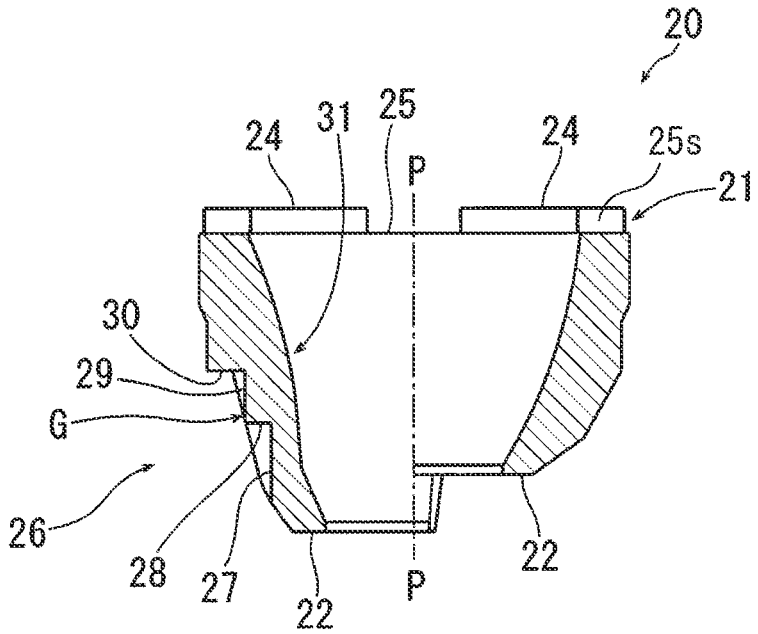
FIG. 9 is a plan view of the second member.
Figure 10:
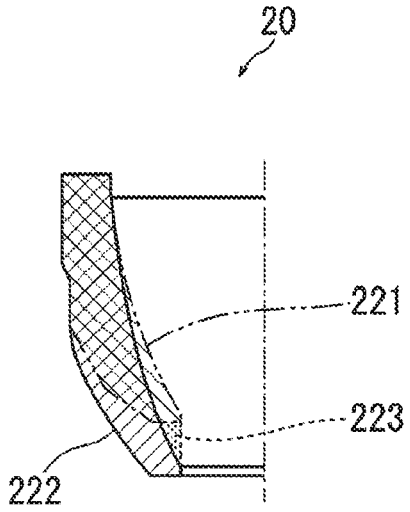
FIG. 10 is a sectional view taken along X-X line in FIG. 5.

The wiper 8 according to the present embodiment is described in detail. FIG. 2 is a perspective view showing the wiper in FIG. 1, FIG. 3 is a longitudinal sectional view showing the wiper 8 in FIG. 1, FIG. 4 is a plan view of FIG. 3, FIG. 5 is a bottom view of FIG. 3, FIG. 6 is a longitudinal sectional view of a first member, FIG. 7 is a bottom view of the first member, FIG. 8 is a longitudinal sectional view of a second member, FIG. 9 is a plan view of the second member, and FIG. 10 is a sectional view taken along X-X line in FIG. 5.

The wiper 8 includes a first member 10 and a second member 20. The first member 10 and the second member 20 are formed by double molding so that a lower end portion of the first member 10 and an upper end portion of the second member 20 are joined together. Hereinafter, the lower end portion of the first member is referred to as a first joining portion 11, and the upper end portion of the second member 20 is referred to as a second joining portion 21. For the first member 10, a resin that has appropriate rigidity and can be easily double-molded with another material is selected, and for example, polyethylene, polypropylene, ABS resin, or the like is used. For the second member 20, a resin softer than the first member 10 is selected, and for example, thermosetting elastomer, polyethylene, silicon, or the like is used. Alternatively, the same resin may be used for the first member 10 and the second member 20, which are made different in hardness from each other.

The first member 10 is a cylindrical member to be fixed to an inner circumference of the opening 7. As shown in FIG. 3 and FIG. 4, etc., an upper end portion of the first member 10 is formed into a flange portion 12. The flange portion 12 comes into contact with an upper end surface of the opening 7 to prevent the wiper 8 from moving further downward. On an outer surface of the first member 10, two annular ribs 13 are formed. The annular ribs 13 serve as stoppers for the wiper 8 by interfering with an inner surface of the reduced-diameter portion 6.

Figure 6:
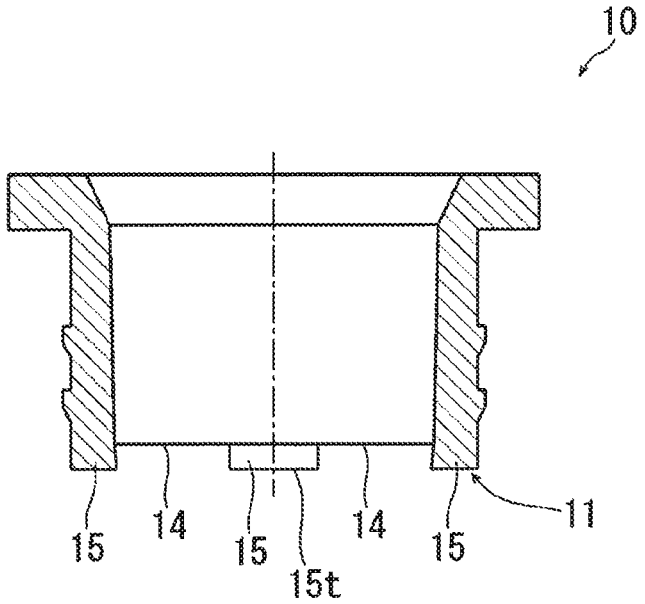
FIG. 6 is a longitudinal sectional view of a first member.
Figure 7:
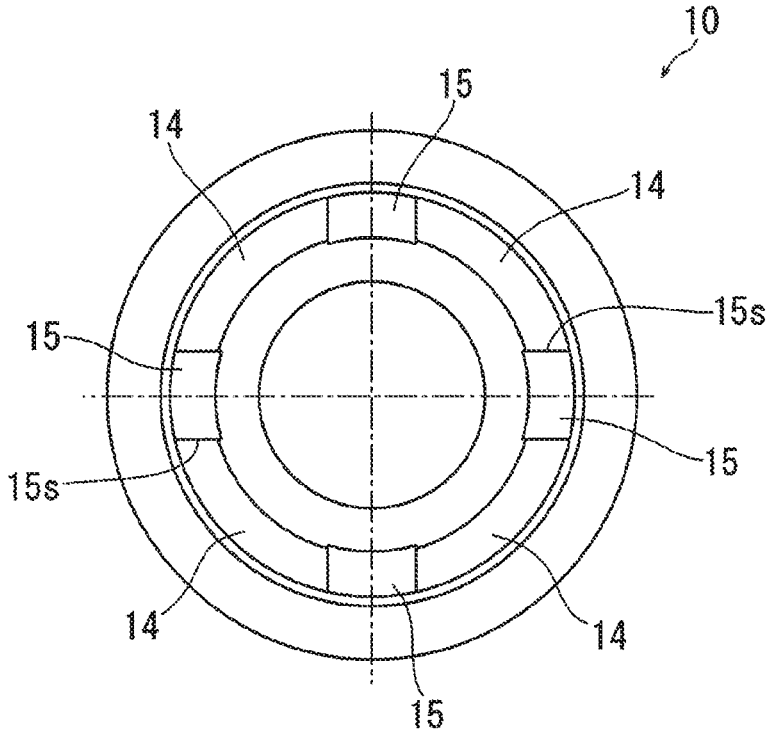
FIG. 7 is a bottom view of the first member.

As shown in FIG. 6 and FIG. 7, the joining portion 11 of the first member 10 is formed basically of a flat horizontal surface 14. On the horizontal surface 14, a plurality of projection portions 15 having rectangular parallelepiped shapes extending toward the second member 20 are formed discretely in a circumferential direction. In the present embodiment, projection portions 15 are formed at four positions at even intervals on the horizontal surface 14.

The second member 20 is formed into a truncated cone shape narrowing from the second joining portion 21 toward a free end portion 22 while assuming a cylindrical and gently rounded shape. The free end portion 22 of the second member 20 comes into close contact with the application portion 5 and the shaft portion of the application portion 5 and scrapes off excessive cosmetic liquid 2 when the application portion 5 is pulled out. As shown in FIG. 3 and FIG. 5, etc., the second member 20 is formed so that a substantially half region in the circumferential direction of the free end portion 22 is offset upward. Therefore, as shown in FIG. 10, a step gap 223 is left between a free end portion 221 on the offset side and a free end portion 222 on the side not offset, and the step gap 223 functions as an air passage to suppress a pumping phenomenon of the wiper.

As shown in FIG. 8 and FIG. 9, the joining portion 21 of the second member 20 is also formed basically of a flat horizontal surface 24. On the horizontal surface 24, a plurality of recess portions 25 having rectangular parallelepiped shapes in which the projection portions 15 are inserted are formed discretely in the circumferential direction.

As shown in FIG. 3 and FIG. 9, etc., one region in the circumferential direction of the outer surface of the second member 20 is notched into steps descending from the free end portion 22 toward the joining portion 21, and thus a stepped portion 26 is formed. In the present embodiment, on the side not offset of the second member 20, the stepped portion 26 is formed in a substantially ⅙ circumferential region of the second member 20, and the number of steps formed in the stepped portion is two between the free end portion 22 and the joining portion 21. In order from the free end portion 22, the reference sign 28 denotes the first step, and the reference sign 30 denotes the second step.

For example, as shown in FIG. 9, the inner surface of the second member 20 has a continuous curve narrowing in a truncated cone shape while assuming a gently rounded shape in a region other than the region in which the stepped portion 26 is formed as seen in the second member 20 on the offset side, however, on the inner surface of the region in which the stepped portion 26 is formed, a swelling portion 31 swelling toward the inside of the second member 20 (toward the axis center P-P of the second member 20) is formed.

As shown in FIG. 9, a gate portion G (gate portion G for secondary injection) of the second member 20 is provided at a lower portion of a vertical portion 29 between the first step 28 and the second step 30. A gate portion (gate portion for primary injection, not shown in the drawings) of the first member 10 is preferably provided in the first joining portion 11. The gate portion is thereby prevented from being exposed to the outer surface of the first member 10. As a molding method, a submarine gate method or a pin gate method is adopted.

An operation and effect of the present embodiment are described. The wiper 8 is formed by double molding of the first member 10 and the second member 20, and a plurality of projection portions 15 and a plurality of recess portions 25 are formed discretely in the circumferential direction basically on the horizontal surfaces 14 and 24 of the joining portions 11 and 21 of the members, and accordingly, even when a force in a rotating direction is applied to the wiper 8 when the application portion 5 is pulled out, side surfaces 15*s* (refer to FIG. 7) of the projection portions 15 and side surfaces 25*s* (refer to FIG. 8) of the recess portions 25 interfere with each other, so that the first member 10 and the second member 20 can be prevented from separating.

In the present embodiment, each projection portion 15 is formed into a rectangular parallelepiped shape, and no recesses or projections are provided on a top surface 15*t* (refer to FIG. 6) that comes into contact with the recess portion 25 in the vertical direction and the side surfaces 15*s*. Because the projection portions 15 have no frail portions, the projection portions 15 can be prevented from losing shape when the resin of the second member 20 flows thereto.

In addition, by providing the stepped portion 26 on the outer surface of the second member 20 and providing the gate portion G of the second portion 20 on the stepped portion 26, problems can be prevented from occurring by burrs that are produced at the gate portion G. Because a soft resin is used for the second member as described above, when the product part and the gate part are cut, the resin stretches in many cases. When such residue (burrs) of the gate remains on the outer surface of the second member 20, problems occur in which the residue is caught when the wiper 8 is press-fitted in the reduced-diameter portion 6 of the cosmetic container 3. However, in the present embodiment, on the assumption that the resin stretches, the shape is designed so that, even when the resin stretches, the resin remains within the notch in the stepped portion 26. That is, the region shown by the dashed line in FIG. 3 shows an outline of the second member 20 when the notch of the stepped portion 26 is not formed, however, in the present embodiment, even when the resin stretches, the resin fits within this region shown by the dashed line. Accordingly, burrs can be prevented from being caught when the wiper 8 is fixed to the cosmetic container 3.

It is preferable that the stepped portion 26 is formed so that a minimum thickness Tmin (refer to FIG. 3) of the second member 20 after notching is 0.5 mm or more, and a notching width Nh (refer to FIG. 3) is 0.4 mm or more from the outline (described above). This is because it has been confirmed that no molding defect due to notching of the product to form the stepped portion 26 occurs, and burrs do not project to the outside from the outline.

In the present embodiment, the stepped portion 26 is formed to have two steps. This number of steps may be more than two, however, when two steps are provided, the flow of molten resin can be prevented from being deteriorated by a complicated shape of the wiper 8 that is originally a small component. The number of steps may be set to one, however, if one step is formed for the wiper 8 having a truncated cone shape, a very thin portion is formed, so that the flow of the molten resin may deteriorate or deterioration in strength may occur. Therefore, the number of steps in the stepped portion 26 is preferably set to two.

In the present embodiment, the gate portion G is provided at a lower portion of the vertical portion 29 between the first step 28 and the second step 30. The gate portion G may be provided on the vertical portion 27 (refer to FIG. 9) between the free end portion 22 and the first step 28, however, at this position of the vertical portion 27, the above-described residue of the gate may project downward beyond the free end portion 22 when it stretches downward. In addition, the vertical portion 27 positioned lower than the vertical portion 29 is thin in thickness, so that it may deform at the time of gate cutting. Therefore, when the number of steps is set to two, the gate portion G is preferably provided on the side of a thicker member, and when the number of steps is set to be more than two, the gate portion G is preferably provided on a step near the center position.

In addition, since the swelling portion 31 is formed on an inner surface of the region in which the stepped portion 26 is formed in the second member 20, resin fluidity can be stabilized. When an outer surface is notched to form the stepped portion 26, the region in which the stepped portion 26 is formed becomes thinner in thickness than a region in which the stepped portion 26 is not formed. In the present embodiment, by forming the swelling portion 31 that substantially equalizes the thickness of the region in which the stepped portion 26 is formed and the thickness of the region in which the stepped portion 26 is not formed, the stability of resin fluidity is attained.

Hereinafter, preferred modifications of the present embodiment are shown.

In the embodiment, the projection portions 15 are provided on the first member 10 and the recess portions 25 are provided on the second member, however, the recess portions and projection portions may be formed in an opposite manner.

In the embodiment, the pair of the projection portion 15 and the recess portion 25 is formed at four positions. The pairs of projection portions 15 and recess portions 25 may be evenly and discretely disposed from the center based on a parting line. When pairs more than four pairs are disposed, higher strength can be obtained in the rotating direction. When pairs less than four pairs are disposed, the level of difficulty in die machining can be lowered. When four pairs are disposed as in the embodiment, minimum strength can be secured, and the die cost can be reduced.

Figure 11:
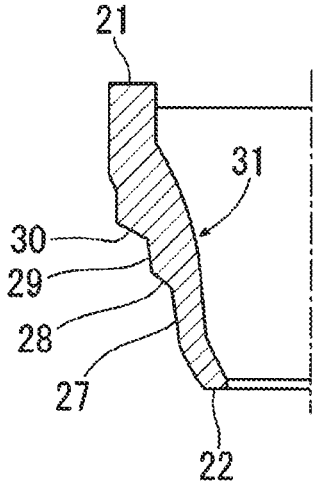
FIG. 11 is a view showing a modification of the embodiment.

In the present embodiment, the first step 28 and the second step 30 of the stepped portion 26 are formed of horizontal surfaces, and vertical portions 27 and 29 thereof are formed of vertical surfaces, however, it is also preferable that any or all of these are inclined. For example, as shown in FIG. 11, when the first step 28, the second step 30, and the vertical portions 27 and 29 are inclined obliquely upward and outward so as to follow the truncated cone-shaped outline, this is preferable because the inclinations guide a flow of resin, and the thickness of the stepped portion 26 can be made more uniform.

A preferred embodiment and modifications of the present invention are described above, and each embodiment and each modification can be combined based on knowledge of a person skilled in the art, and such combined modes are also included in the scope of the present invention.

REFERENCE SIGNS LIST

3 Cosmetic container
7 Opening of cosmetic container
8 Wiper
10 First member
11 First joining portion
14 Horizontal surface
15 Projection portion
20 Second member
21 Second joining portion
22 Free end portion
24 Horizontal surface
25 Recess portion
26 Stepped portion
28 First step of stepped portion
29 Vertical portion between first step and second step
30 Second step of stepped portion
31 Swelling portion

The invention claimed is:

1. A wiper for a cosmetic container comprising:

a cylindrical first member to be fixed to an inner circumference of an opening of a cosmetic container; and a cylindrical second member that is double-molded on a lower end portion of the first member, wherein joining portions of the first member and the second member respectively have horizontal surfaces, on the horizontal surface of either one of the first member and the second member, projection portions projecting from the horizontal surface are formed discretely in a circumferential direction, and recess portions in which the projection portions are inserted are formed on the horizontal surface of the other member, and wherein the second member is formed into a truncated cone shape narrowing from the joining portion toward a free end portion of the second member and includes a stepped portion formed stepwise in one region of a circumferential direction of an outer surface of the second member, and a gate portion is provided on the stepped portion.

2. The wiper for a cosmetic container according to claim 1, wherein the second member includes a swelling portion formed by swelling an inner surface of the region in which the stepped portion is formed.

3. The wiper for a cosmetic container according to claim 2, wherein the stepped portion is provided in a region that does not come into contact with the cosmetic container.

4. The wiper for a cosmetic container according to claim 1, wherein the number of steps in the stepped portion is two.

5. The wiper for a cosmetic container according to claim 4, wherein the stepped portion is provided in a region that does not come into contact with the cosmetic container.

6. The wiper for a cosmetic container according to claim 4, wherein the gate portion is provided on a vertical portion between a first step and a second step of the stepped portion.

7. The wiper for a cosmetic container according to claim 6, wherein the stepped portion is provided in a region that does not come into contact with the cosmetic container.

8. The wiper for a cosmetic container according to claim 1, wherein the stepped portion is provided in a region that does not come into contact with the cosmetic container.

* * * * *